United States Patent [19]

Collumber

[11] 4,075,750

[45] Feb. 28, 1978

[54] CONNECTOR TOOL APPARATUS FOR CEILING CLIPS

[76] Inventor: Ronald E. Collumber, 823 N. Chautauqua, Wichita, Kans. 67214

[21] Appl. No.: 686,175

[22] Filed: May 13, 1976

[51] Int. Cl.[2] ..... B25B 27/14

[52] U.S. Cl. ..... 29/278

[58] Field of Search ..... 29/278, 281, 270, 240; 81/90 C, 125

[56] References Cited

U.S. PATENT DOCUMENTS

| | | | |
|---|---|---|---|
| 2,739,500 | 3/1956 | Kordish | 81/90 C |
| 3,890,692 | 6/1975 | Jandura | 29/270 |
| 3,903,762 | 9/1975 | Acrea | 81/90 C |

FOREIGN PATENT DOCUMENTS

| | | | |
|---|---|---|---|
| 21,465 | 1968 | Japan | 81/90 C |

*Primary Examiner*—James L. Jones, Jr.
*Attorney, Agent, or Firm*—Phillip A. Rein

[57] ABSTRACT

This invention is a connector tool apparatus used to attach a hanger clip to a ceiling T-bar member and connect a light fixture to the hanger clip. The connector tool apparatus includes a handle assembly integral with an actuator assembly. The handle assembly includes a main body resembling a screw driver handle connected to a clip connector assembly. The clip connector assembly includes a connector coupling having a central threaded hole to receive a threaded shaft of the hanger clip therein during use thereof. The actuator assembly includes a U-shaped connector arm with parallel arm sections, each integral with a connector head of conical shape. The connector heads cooperate to rotate a connector nut of the hanger clip during assembly thereof.

2 Claims, 4 Drawing Figures

CONNECTOR TOOL APPARATUS FOR CEILING CLIPS

There are numerous tool patents in the prior art but none are specifically constructed with the features of this invention to apply hanger clips to a T-bar member. A substantial effort is required to secure hanger clips without the tool apparatus of this invention.

In one embodiment of this invention, the connector tool apparatus includes a handle assembly integral with an actuator assembly. The handle assembly includes a main body having a clip connector assembly connected thereto. The main body resembles a screw driver handle having a circumferential groove section to aid in gripping during usage. The clip connector assembly has a connector coupling; a shaft member embedded in the main body and threadably mounted in the connector coupling; and a set screw member mounted in a central threaded hole in the connector coupling. The set screw member has an inner conical end section mounted within a hole in the shaft member and operates to expand the shaft member to secure in the main body of the handle assembly. The actuator assembly includes a shaft member extension integral with the shaft member on one end and on the other end to a U-shaped connector arm. The connector arm has a pair of parallel arm sections, each arm section is connected to a connector head of inverted conical shape. The spaced connector heads cooperate to connect a connector nut of the hanger clip.

One object of this invention is to provide a connector tool apparatus readily attachable to ceiling clips and operable to easily transfer the ceiling clip to a ceiling T-bar member in a quick and easy manner.

Another object of this invention is to provide a connector tool apparatus resembling a screw driver member having opposite ends connectable to parts of a hanger clip for connection to a T-bar member.

One other object of this invention is to provide a connector tool apparatus that is sturdy in construction, easy to use, economical to manufacture, and unique in operation.

Various other objects, advantages, and features of the invention will become apparent to those skilled in the art from the following discussion, taken in conjunction with the accompanying drawings, in which.

Figure 1:
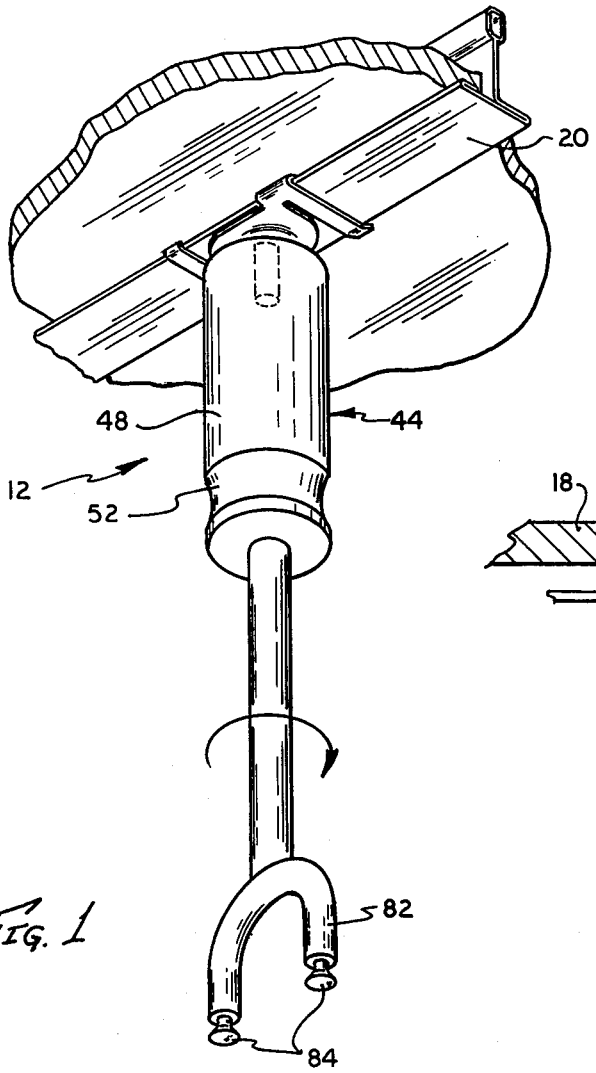
FIG. 1 is a perspective view of a connector tool apparatus of this invention illustrated as connecting a hanger clip to a T-bar member which, in turn, supports ceiling tile.

The following is a discussion and description of preferred specific embodiments of the new connector tool apparatus of this invention, such being made with reference to the drawings, whereupon the same reference numerals are used to indicate the same or similar parts and/or structure. It is to be understood that such discussion and description is not to unduly limit the scope of the invention.

In one preferred embodiment as shown in FIG. 1, a connector tool apparatus, indicated generally at 12, is connectable to a hanger clip 14 which is secured to a T-bar member 16 by the tool of this invention.

Figure 2:
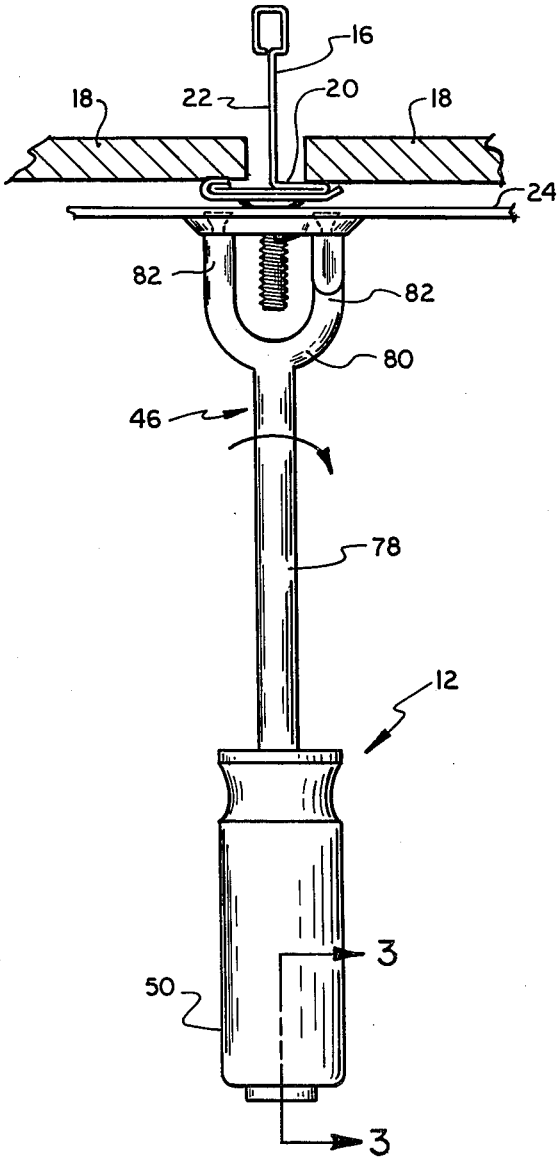
FIG. 2 is a side elevational view of the connector tool apparatus of this invention illustrated as attaching a connector nut to the hanger clip as shown in FIG. 1.

As best shown in FIG. 2, the T-bar member 16 is used to support ceiling tile members 18 against a horizontally extended bottom wall 20. The T-bar member 16 has a central, vertically extended support leg 22 which is held by steel cable or other support members in a conventional manner. The connector tool apparatus 12 is used to connect the hanger clip 14 to the bottom wall 20 which, in turn, is used to support a light fixture or other such items next to the ceiling tile members 18. A top wall 24 of a light fixture is shown in FIG. 2.

Figure 4:
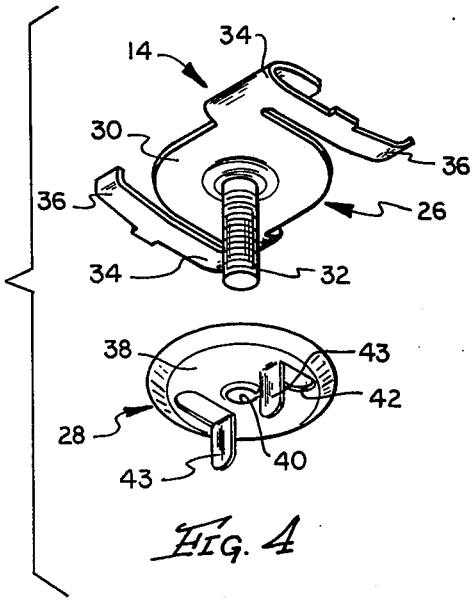
FIG. 4 is a perspective view of a hanger clip member used with the connector tool apparatus of this invention.

As shown in FIG. 4, the hanger clip 14 includes an anchor assembly 26 to which a connector nut 28 is attachable. The anchor assembly 26 includes a body section 30; a threaded connector shaft 32 secured to and extended perpendicular to the body section 30; connector clip sections 34 integral with the body section 30; and parallel, spaced anchor arms 36 integral with the connector clip sections 34. The clip sections 34 are of a J-shape in transverse cross section to fit snugly about outer edges of the bottom wall 20 of the T-bar member 16 when connected thereto (FIG. 2). The anchor arms 36 have outer curved end sections 37 to grasp the bottom wall 20 when in the connected condition.

The connector nut 28 has a main disc member 38; a central threaded hole 40 in the disc member 38; and a pair of radially opposed, U-shaped openings 42 punched out of the disc member 38 to form laterally extended wing sections 43. Prior to this invention, the wing sections 43 were used similar to opposed arms of a wing nut for threading onto the connector shaft 32 as will be explained.

The connector tool apparatus 12 includes a handle assembly 44 integral with an actuator assembly 46. The handle assembly 44 has a clip connector assembly 50 embodied in a main body 48. The main body 48 is of a molded plastic construction having a groove section 52 for ease of grasping. The main body 48 resembles a conventional screw driver handle structure.

The clip connector assembly 50 includes a connector coupling 54; a shaft member 56 connected to the connector coupling 54; and a set screw member 58 mounted in the connector coupling 54 and engagable with the shaft member 56. The connector coupling 54 has a central threaded hole 60 open outwardly at an end wall 62.

The shaft member 56 includes a connector end section 64 having external threads 66 and a central hole 68. The central hole 68 has slots 70 in the surrounding side wall for reasons to be explained.

The set screw member 58 includes a conical end section 72; outer threaded area 74; and a central allen screw opening 76. The thread hole 60 in the connector coupling 54 and the outer threaded area 74 of the set screw member 58 are compatible.

Figure 3:
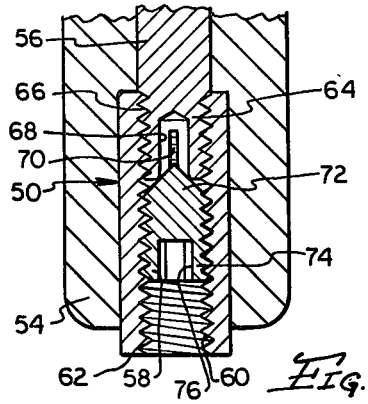
FIG. 3 is an enlarged fragmentary sectional view taken along line 3—3 in FIG. 2.

As seen in FIG. 3, the connector end section 64 of the shaft member 56 is threaded into the connector coupling 54 and the conical end section 72 of the set screw member 58 is forced into the central hole 68. Due to the slots 70, the connector end section 64 expands to secure the shaft member 56 in the connector coupling 54.

The actuator assembly 46 includes a shaft member extension 78 integral at one end with the shaft member 56 and at the other end with a U-shaped connector arm 80.

The connector arm 80 has a pair of spaced, parallel arm sections 82, each having an inverted, conical shaped connector head 84 on the outer end thereof. The connector heads 84 have the narrow portion adjacent the arm sections 82 with the wide base thereof on the outer extreme.

In the use and operation of the connector tool apparatus 12 of this invention, as shown in FIGS. 1 and 2, the T-bar member 16 is secured to a support beam or the like as by wire cable or other means to form a grid-like support system. The bottom wall 20 of the T-bar member 16 is extended horizontally to support the ceiling tile members 18 in a conventional manner.

The hanger clip 14 is operable to be connected to the bottom wall 20 and usable to support a fluorescent light fixture or the like thereon. More specifically, the threaded connector shaft 32 of the anchor assembly 26 is threaded into the central threaded hole 60 of the connector coupling 54 of the clip connector assembly 50. The end wall 62 is abutted against the body section 30 of the anchor assembly 26 when the connector shaft 32 is fully threaded into the hole 60.

Next, the clip sections 34 are placed adjacent the outer edges of the bottom wall 20 of the T-bar member 16. The connector tool apparatus 12 is moved upwardly to depress the anchor arms 36 against the bottom wall 20. Concurrently, the connector tool apparatus 12 is rotated clockwise as shown in FIG. 1 by the arrow to grasp the bottom wall 20 with the clip sections 34. The anchor arms 36 have outer curved end sections 37 which cooperates with the anchor arms 36 to securely grasp the bottom wall 20 of the T-bar member 16.

The connector tool apparatus 12 is then removed from the anchor assembly 26 by rotation of the handle assembly 44 in a counter-clockwise direction to unthread from the connector coupling 54.

As shown in FIG. 2, the connector nut 28 is then placed on the connector tool apparatus 12 by having the conical connector heads 84 inserted in the U-shaped openings 42. The threaded hole 40 is placed against the connector shaft 32 and the connector tool apparatus 12 is rotated clockwise as shown in FIG. 2. This operates to secure a top wall 24 of a light fixture between the connector nut 28 and anchor assembly 26 to securely support same.

Finally, it is obvious that the handle assembly 44 is rotated a small amount in a counter-clockwise direction as shown in FIG. 2 to release the conical heads 84 from the U-shaped openings 42. Then, downward movement of the connector tool apparatus 12 releases same from the hanger clip 14 and the entire process can be repeated to secure another hanger clip 14.

It is seen that the connector tool apparatus of this invention is rigid in construction, easy to carry in a tool belt or box, and easy to use. The prior application of hanger clips to T-bar members has been a difficult and time consuming task normally resulting in injured fingers and knuckles. The connector tool apparatus of this invention overcomes these problems in an efficient and effective manner.

While the invention has been described in conjunction with preferred specific embodiments thereof, it will be understood that this description is intended to illustrate and not to limit the scope of the invention, which is defined by the following claims.

I claim:

1. A connector tool apparatus operable to secure a hanger clip to a bottom wall of a T-bar member; comprising:

(a) a handle assembly secured to an actuator assembly;

(b) said handle assembly having a clip connector assembly connectable to an anchor assembly of the hanger clip to secure the anchor assembly to the T-bar member;

(c) said actuator assembly having a connector arm;

(d) said connector arm having parallel arm sections;

(e) each arm section having an outer connector head connectable to a connector nut of the hanger clip; whereby said connector arm is rotatable to place the connector nut on the anchor assembly;

(f) said clip connector assembly having a connector coupling connected to a shaft member;

(g) said connector coupling having a threaded opening to threadably receive a connector shaft of the hanger clip in order to rotate the anchor assembly;

(h) said shaft member having an externally threaded end section with a central hole therein;

(i) said clip connector assembly having a set screw member threadably mounted in said threaded opening in said connector coupling; and (j) said set screw member having a conical end section mounted in said central hole to secure said shaft member to said connector coupling.

2. A connector tool apparatus as described in claim 1, wherein:

(a) said handle assembly having a main body mounted about said connector coupling and said shaft member to resemble a screw driver handle for ease of grasping.

* * * * *